US010202850B2

(12) United States Patent
House

(10) Patent No.: US 10,202,850 B2
(45) Date of Patent: Feb. 12, 2019

(54) BALANCING METHOD FOR A TURBOCHARGER

(71) Applicant: BorgWarner Inc., Auburn Hills, MI (US)

(72) Inventor: Timothy Mark House, Hendersonville, NC (US)

(73) Assignee: BorgWarner Inc., Auburn Hills, MI (US)

( * ) Notice: Subject to any disclaimer, the term of this patent is extended or adjusted under 35 U.S.C. 154(b) by 312 days.

(21) Appl. No.: 15/125,293

(22) PCT Filed: Mar. 4, 2015

(86) PCT No.: PCT/US2015/018664
§ 371 (c)(1),
(2) Date: Sep. 12, 2016

(87) PCT Pub. No.: WO2015/142517
PCT Pub. Date: Sep. 24, 2015

(65) Prior Publication Data

US 2017/0074103 A1 Mar. 16, 2017

Related U.S. Application Data

(60) Provisional application No. 61/955,896, filed on Mar. 20, 2014.

(51) Int. Cl.
*F01D 5/02* (2006.01)
*F01D 5/04* (2006.01)
(Continued)

(52) U.S. Cl.
CPC ..... *F01D 5/027* (2013.01); *F01D 5/04* (2013.01); *F01D 21/003* (2013.01);
(Continued)

(58) Field of Classification Search
CPC ..... F01D 5/027; F01D 5/04; F01D 21/003; F01D 25/162; F04D 29/053;
(Continued)

(56) References Cited

U.S. PATENT DOCUMENTS 6,942,460 B2 9/2005 Osako et al.
8,365,406 B2 2/2013 Cornelio
(Continued)

FOREIGN PATENT DOCUMENTS

JP 2002047944 A 2/2002
JP 2010096036 A 4/2010
WO 2014008117 A1 1/2014

OTHER PUBLICATIONS

International Search Report and Written Opinion; dated Jun. 11, 2015; for International Application No. PCT/US2015/018664; 9 pages.

*Primary Examiner* — Moshe Wilensky
(74) *Attorney, Agent, or Firm* — BrooksGroup

(57) ABSTRACT

A method of balancing turbocharger rotating assembly (50) includes installing a shaft-and-turbine wheel sub-assembly (40) into a ball bearing cartridge (20) within a bearing housing (8) of a turbocharger (1), connecting a compressor wheel (5) to the shaft (6), and testing the balance of the turbocharger rotating assembly (50) while the turbocharger rotating assembly (50) is installed within the bearing housing (8) of the turbocharger (1). Based on the results of the balance testing, material is removed from the turbine wheel (4) while the shaft-and-turbine wheel sub-assembly (40) is installed within the bearing housing (8) of the turbocharger (1). The step of removing the material from the turbine wheel (4) comprises removing material from a peripheral edge (35) of a backwall (34) of the turbine wheel (4).

15 Claims, 9 Drawing Sheets

(51) Int. Cl.

| | |
|---|---|
| ***F01D 21/00*** | (2006.01) |
| ***F01D 25/16*** | (2006.01) |
| ***F04D 27/00*** | (2006.01) |
| ***F04D 29/053*** | (2006.01) |
| ***F04D 29/056*** | (2006.01) |
| ***F04D 29/28*** | (2006.01) |
| ***F04D 29/66*** | (2006.01) |
| *F02B 39/16* | (2006.01) |

(52) U.S. Cl.
CPC ..... *F01D 25/162* (2013.01); *F04D 27/001* (2013.01); *F04D 29/053* (2013.01); *F04D 29/056* (2013.01); *F04D 29/284* (2013.01); *F04D 29/662* (2013.01); *F02B 39/16* (2013.01); *F05D 2220/40* (2013.01); *F05D 2240/60* (2013.01)

(58) Field of Classification Search
CPC .... F04D 29/056; F04D 29/284; F04D 27/001; F04D 29/662; F05D 2240/60; F05D 2220/40
See application file for complete search history.

(56) References Cited

U.S. PATENT DOCUMENTS

| | | | | |
|---|---|---|---|---|
| 2009/0136368 | A1 | 5/2009 | Arnold et al. | |
| 2012/0003093 | A1 | 1/2012 | Lischer et al. | |
| 2012/0115667 | A1 | 5/2012 | Lohr et al. | |
| 2013/0195391 | A1 | 8/2013 | Cornelio | |
| 2016/0208682 | A1* | 7/2016 | Naruoka ..... | F02B 33/40 |

* cited by examiner

BALANCING METHOD FOR A TURBOCHARGER

CROSS-REFERENCE TO RELATED APPLICATIONS

This application claims priority to and all the benefits of U.S. Provisional Application No. 61/955,896, filed on Mar. 20, 2014, and entitled "Balancing Method For A Turbocharger," which is incorporated herein by reference.

BACKGROUND

1. Field of the Invention

The present invention relates to a method for balancing a shaft-and-wheel assembly of a turbocharger.

2. Description of Related Art

Turbochargers are provided on an engine to deliver air to the engine intake at a greater density than would be possible in a normal aspirated configuration. This allows more fuel to be combusted, thus boosting the engine's horsepower without significantly increasing engine weight.

Generally, turbochargers use the exhaust flow from the engine exhaust manifold, which enters the turbine housing at a turbine inlet, to thereby drive a turbine wheel, which is located in the turbine housing. The turbine wheel is affixed to one end of a shaft, wherein the shaft drives a compressor wheel mounted on the other end of the shaft. As such, the turbine wheel provides rotational power to drive the compressor wheel and thereby drive the compressor of the turbocharger. This compressed air is then provided to the engine intake as described above.

The compressor stage of the turbocharger comprises the compressor wheel and its associated compressor housing. Filtered air is drawn axially into a compressor air inlet which defines a passage extending axially to the compressor wheel. Rotation of the compressor wheel forces pressurized air flow radially outwardly from the compressor wheel into the compressor volute for subsequent pressurization and flow to the engine.

Turbocharger efficiency has been increased by the adoption of rolling element bearings (REB) to support the rotating assembly that includes the turbine wheel, the compressor wheel, and the connecting shaft. For example, there is an improvement in transient response of the turbocharger due to the reduction in power losses, especially at low turbocharger RPM, of the REB system over some typical turbocharger bearing systems such as hydrodynamic sleeve-type bearing systems. REB systems can also support much greater thrust loads than can typical turbocharger bearing systems, making the thrust component more robust. However, REBs have a finite fatigue life which is sensitive to the loads being transmitted through them. The bearing loads are dependent on the level of imbalance of the wheels, so the fatigue life of the REB is sensitive to the imbalance of the turbine and compressor wheels. There exists, therefore, a need to ensure that the imbalance levels of the turbine and compressor wheels are as low as possible during operation of the turbocharger.

SUMMARY

In some aspects, a method of balancing a rotating assembly of a turbocharger includes performing initial balancing of a shaft-and-turbine wheel subassembly to provide an initially-balanced shaft-and-turbine wheel subassembly; inserting the initially-balanced shaft-and-turbine wheel subassembly into a bearing, where the bearing is in a bore of a bearing housing of the turbocharger; securing a compressor wheel to the balanced shaft-and-turbine wheel subassembly to form the turbocharger rotating assembly; performing low speed balance testing of the turbocharger rotating assembly including measurement of low speed vibrations, while the turbocharger rotating assembly is positioned within the bore; comparing the measured low speed vibrations to a first predetermined level of acceptable vibration; based on the results of comparing the measured low speed vibrations to a first predetermined level of acceptable vibration, determining whether balance correction of the turbocharger rotating assembly is necessary; if the measured low speed vibrations exceed the predetermined level, performing balance correction of the turbocharger rotating assembly by removing material from a turbine wheel of the shaft-and-turbine wheel subassembly while the shaft-and-turbine wheel subassembly is installed in the bearing, and the bearing is installed within the bore; performing high speed balance testing of the turbocharger rotating assembly including measurement of high speed vibrations, while the turbocharger rotating assembly is positioned within the bore; comparing the measured high speed vibrations to a second predetermined level of acceptable vibration; based on the results of comparing the measured high speed vibrations to a second predetermined level of acceptable vibration, determining whether balance correction of the turbocharger rotating assembly is necessary; and if the measured high speed vibrations exceed the second predetermined level, performing balance correction of the turbocharger rotating assembly by removing material from the compressor wheel while the turbocharger rotating assembly is installed within the bearing housing.

The method may include one or more of the following steps and/or features: The step of removing the material from the turbine wheel comprises removing material from a peripheral edge of a backwall of the turbine wheel. The step of removing material from a peripheral edge of a backwall of the turbine wheel includes removing material between a pair of adjacent turbine blades such that the peripheral edge is not symmetric in the circumferential direction about an axis of rotation of the turbine wheel. The step of removing material from a peripheral edge of a backwall of the turbine wheel includes the step of machining at least one scallop that is elongated in the circumferential direction of the turbine wheel. The step of removing material from a peripheral edge of a backwall of the turbine wheel includes the step of machining at least one scallop that is generally semi-circular. The step of removing the material from the turbine wheel comprises advancing a cutting tool toward a backwall of the turbine wheel by approaching from a nose-side of the turbine wheel. Testing the balance of the unbalanced shaft-and-turbine wheel subassembly comprises causing the shaft to rotate; and measuring the vibrations of the at least one of the shaft and turbine wheel. Installing a shaft-and-turbine wheel subassembly into a bearing within a bearing housing of a turbocharger comprises inserting a free end of the shaft of the unbalanced shaft-and-turbine wheel subassembly into the bore on a turbine side of the bearing housing until the free end protrudes outward from the bore on a compressor side of the bearing housing; and mounting the bearing on the shaft of the unbalanced shaft-and-turbine wheel subassembly by inserting the bearing into the bore on the compressor side of the bearing housing while performing the step of inserting the free end of the shaft, until the bearing abuts the portion of the bearing housing and such that the bearing is interposed between the shaft and the bore. The bearing is a roller element bearing cartridge.

In some aspects, a method of balancing a rotating assembly of a turbocharger, where the rotating assembly comprises a shaft, a turbine wheel connected to one end of the shaft, a compressor wheel connected to another end of the shaft, and a bearing assembly that supports the shaft within a bore of the turbocharger, the method comprising the steps of: performing low speed balance testing of the turbocharger rotating assembly including measurement of low speed vibrations, while the turbocharger rotating assembly is positioned within the bore; and based on results of the low speed balance testing, performing a first balance correction of the turbocharger rotating assembly by removing material from a turbine wheel of the shaft-and-turbine wheel subassembly while the shaft-and-turbine wheel subassembly is installed in the bearing, and the bearing 20 is installed within the bore.

The method may include one or more of the following steps and/or features: The method further includes performing high speed balance testing of the turbocharger rotating assembly including measurement of high speed vibrations, while the turbocharger rotating assembly is positioned within the bore; and based on results of the high speed balance testing, performing a second balance correction of the turbocharger rotating assembly by removing material from the compressor wheel while the turbocharger rotating assembly is installed within the bearing housing. The step of removing the material from the turbine wheel comprises removing material from a peripheral edge of a backwall of the turbine wheel. The step of removing material from a peripheral edge of a backwall of the turbine wheel includes removing material between a pair of adjacent turbine blades such that the peripheral edge is not symmetric in the circumferential direction about an axis of rotation of the turbine wheel. The step of removing the material from the turbine wheel comprises advancing a cutting tool toward a backwall of the turbine wheel by approaching from a nose-side of the turbine wheel.

A method of balancing a rotating assembly of an exhaust gas turbocharger is provided. The rotating assembly includes a shaft-and-turbine wheel subassembly that is installed within a bearing cartridge in the bearing housing of the turbocharger, and the compressor wheel that is connected to the shaft of the subassembly. The method reduces the imbalance on the turbine wheel following assembly with the ball bearing cartridge and compressor wheel, but prior to high speed core balancing. The method includes testing and correcting the balance of the rotating assembly while rotating assembly is installed within the bearing housing.

This method permits balancing without extra installation and removal steps, and reduces the likelihood of contaminating the ball bearing cartridge with grinding debris, which can occur in some conventional methods where balancing the subassembly is performed externally of the bearing housing. Advantageously, the method does not require a special fixture for balancing the subassembly, and further does not require a design change to the center bearing housing in which the turbine-end seal ring diameter is enlarged. By avoiding an enlarged seal ring diameter in the center bearing housing, increased oil leakage from the bearing housing can be avoided. In addition, increased exhaust gas entry into the bearing housing through an enlarge turbine end seal ring can be avoided, preventing entry of such "blow by" into the engine crankcase.

In some aspects, a turbine wheel for a turbocharger includes a hub extending in an axial direction between a nose and a backwall. The backwall includes a peripheral edge and the hub defines an axis of rotation extending in the axial direction. A plurality of turbine blades is coupled to the hub and the turbine blades are disposed in a circumferential direction generally at equal intervals around the axis of rotation. At least one scallop is formed in the peripheral edge of the backwall to balance the turbine wheel by approaching the backwall with a cutting tool from the nose-end of the turbine wheel while the shaft-and-turbine wheel subassembly is disposed within the bearing cartridge within the bore of the center bearing housing. In some embodiments, the scallop is elongated in the circumferential direction such that material is removed from the back-wall over a designated angle. In other embodiments, the scallop is generally semi-circular such that material is removed from the back-wall with a single plunge of a cutting tool. The scallop is positioned along the peripheral edge such that the peripheral edge is not symmetrical in the circumferential direction about the axis of rotation.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION

Figure 1:
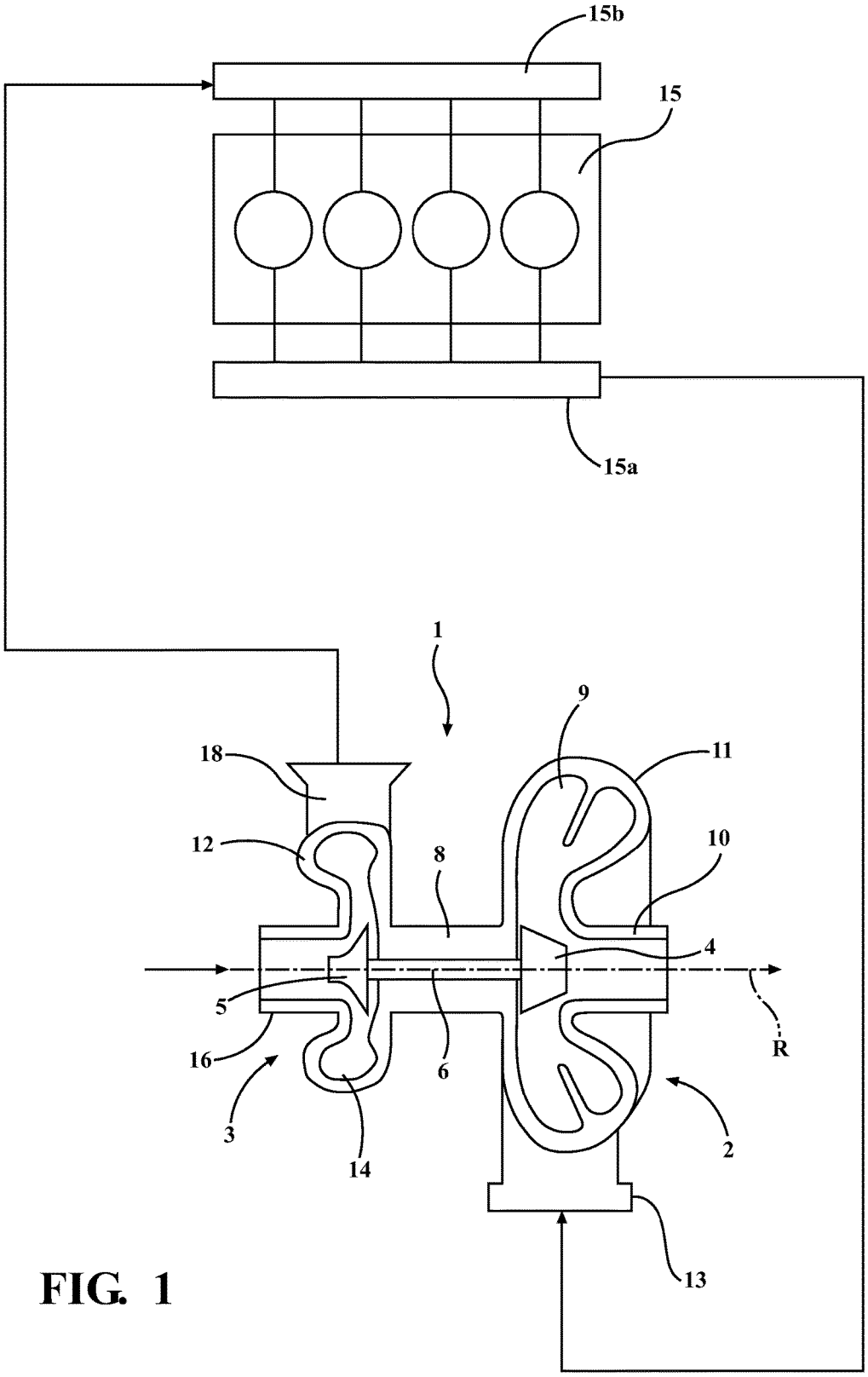
FIG. 1 is a schematic view of an engine including an exhaust gas turbocharger.
Figure 2:
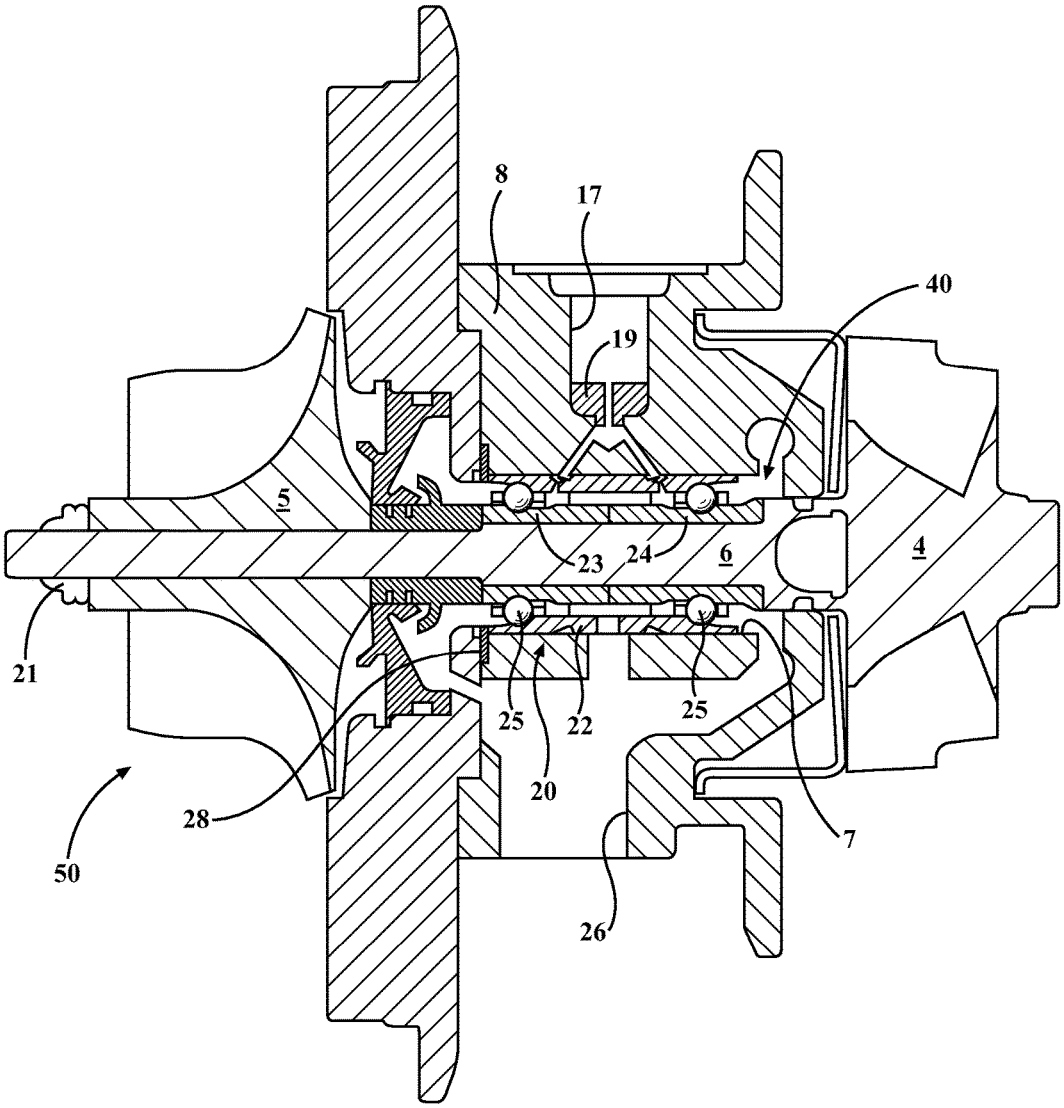
FIG. 2 is a side sectional view of a turbocharger bearing housing with a turbocharger rotating assembly disposed in an axial bore thereof.

Referring to FIGS. 1-2, an exhaust gas turbocharger 1 includes a turbine section 2, the compressor section 3, and a center bearing housing 8 disposed between and connecting the compressor section 3 to the turbine section 2. The turbine section 2 includes a turbine housing 11 that defines an exhaust gas inlet 13, an exhaust gas outlet 10, and a turbine volute 9 disposed in the fluid path between the exhaust gas inlet 13 and exhaust gas outlet 10. A turbine wheel 4 is disposed in the turbine housing 11 between the turbine volute 9 and the exhaust gas outlet 10.

The compressor section 3 includes a compressor housing 12 that defines the air inlet 16, an air outlet 18, and a compressor volute 14. A compressor wheel 5 is disposed in the compressor housing 12 between the air inlet 16 and the compressor volute 14. The compressor wheel 5 is connected to a shaft 6. The shaft 6 connects the turbine wheel 4 to the compressor wheel 5. The shaft 6 is supported within an axial bore 7 in the bearing housing 8 via a rolling element bearing cartridge 20, as discussed further below.

In use, the turbine wheel 4 in the turbine housing 11 is rotatably driven by an inflow of exhaust gas supplied from the exhaust manifold 15*a* of an engine 15. Since the drive shaft 6 connects the turbine wheel 4 to the compressor wheel 5 in the compressor housing 12, the rotation of the turbine wheel 4 causes rotation of the compressor wheel 5. As the compressor wheel 5 rotates, it increases the air mass flow rate, airflow density and air pressure delivered to the engine's cylinders via an outflow from the compressor air outlet 18, which is connected to the engine's air intake manifold 15*b*.

Figure 3:
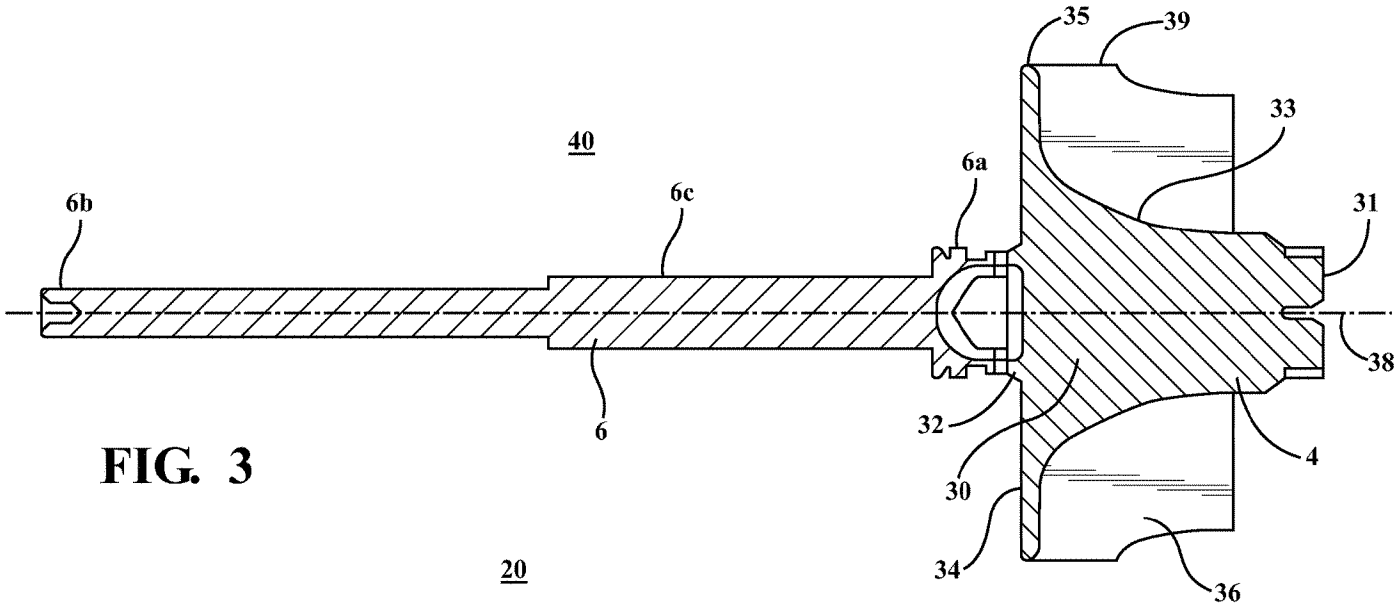
FIG. 3 is a side sectional view of a shaft-and-turbine wheel subassembly.

Referring to FIG. 3, the turbine wheel 4 includes a hub 30 extending in an axial direction between a nose 31 on a front side of the turbine wheel 4 and a weld boss 32 on a back side of the turbine wheel 4. The hub 30 defines a hubline 33 that extends in the axial direction from a point generally adjacent the nose 31 and then diverges outward in a radial direction to a peripheral edge 35 of a backwall 34. The peripheral edge 35 of the backwall 34 coincides with an inlet tip 39 of a plurality of turbine blades 36, thereby defining a "fullback" turbine wheel 4. The turbine blades 36 are disposed in a circumferential direction generally at equal intervals around an axis of rotation 38 of the turbine wheel 4. A proximal end 6*a* of the shaft 6 is fixed to the weld boss 32 of the turbine wheel 4 to form a shaft-and-turbine wheel subassembly 40. The type of connection between the turbine wheel 4 and the shaft 6 is at least partially determined by the material used to form the turbine wheel 4. For example, a nickel based superalloy (i.e., an Inconel™) turbine wheel 4 may be friction welded to the shaft proximal end 6*a*, whereas a turbine wheel 4 formed of titanium aluminide cannot be welded, and is instead secured to the shaft proximal end 6*a* via brazing.

Manufacture of the shaft-and-turbine wheel subassembly 40 may include, for example, the following steps: A turbine wheel casting may be held in a chuck to drill a center hole in the nose 31 on a front side of the turbine wheel casting. The shaft 6 is then welded to the weld boss 32 on a back side of the turbine wheel casting. After heat treating the weld, the shaft-and-turbine wheel casting subassembly is machined, including finish machining a plurality of the turbine blades 32. The shaft distal end 6*b* is then threaded, resulting in a shaft-and-turbine wheel subassembly 40.

Figure 4:
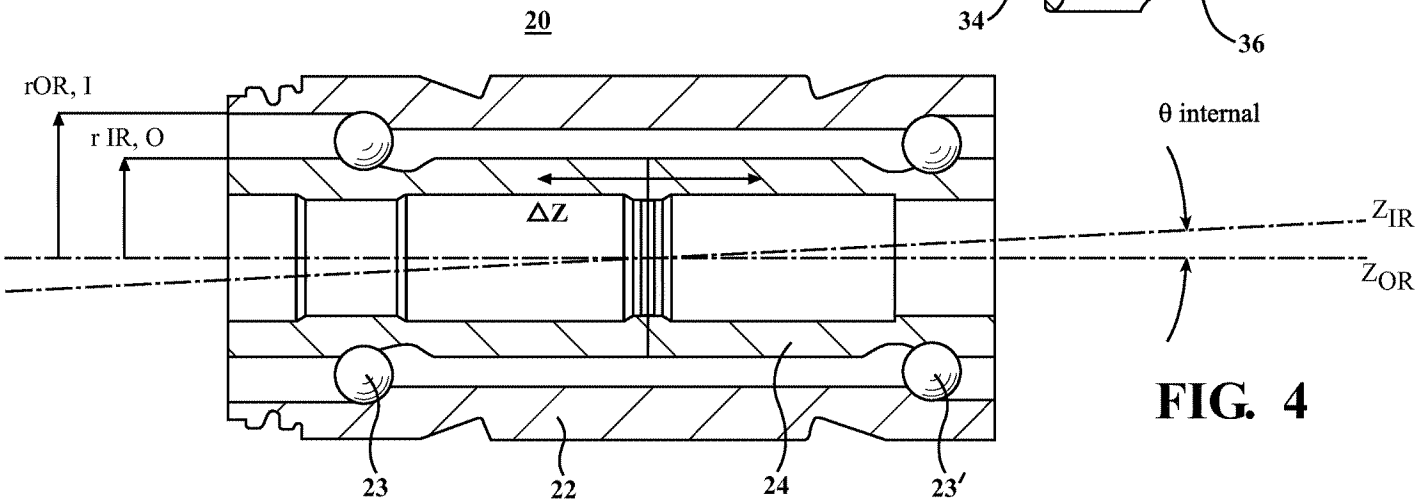
FIG. 4 is a side sectional view of the bearing cartridge.

Referring to FIGS. 2 and 4, the shaft-and-turbine wheel subassembly 40 is supported within the bore 7 via the rolling element bearing cartridge 20. The bearing cartridge 20 includes an inner race 24, two sets of bearings 23, 23' and an outer race 22. The bearing cartridge 20 is prevented from rotating within the bore 7 relative to the bearing housing 8 via an anti-rotation ring 28 interposed between the bearing cartridge 20 and the bearing housing 8, as described in detail in co-pending U.S. patent application Ser. Nos. 13/879,815 and 13/318,658, the contents of which are incorporated by reference herein. The anti-rotation ring 28 includes at least one anti-rotation feature for engaging the bearing housing 8 and at least one anti-rotation feature for engaging the bearing cartridge 20, preventing rotation of the outer race 22 relative to the housing 8.

The shaft-and-turbine wheel subassembly 40, when installed within the bearing cartridge 20 in the bearing housing bore 7 and connected to the compressor wheel 5, provides the rotating assembly 50 of the turbocharger 1.

In some embodiments, the turbine wheel 4 is cast from a nickel based superalloy with over seventy percent (70%) by weight in nickel. As a result, the turbine wheel 4 provides approximately five percent (5%) of the weight of the entire turbocharger 1. Since the relatively heavy turbine wheel 4 is subjected to rotational speeds that typically range from 80,000 rpm up to 300,000 rpm, rotational balance of shaft-and-turbine wheel subassembly 40 is critical for both the performance and the life cycle of the bearing cartridge 20.

Figure 5A:
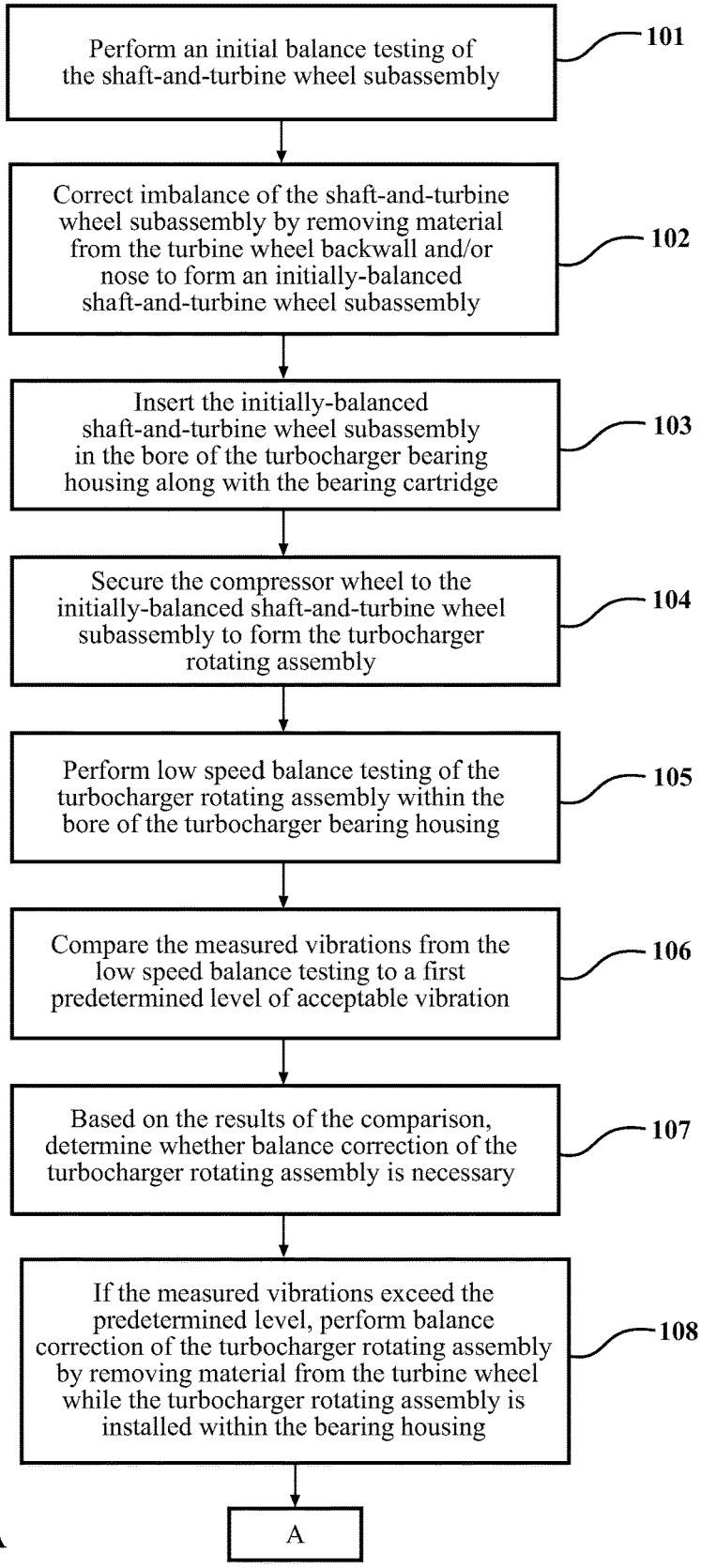
FIGS. 5A and 5B are a flow chart illustrating the steps of the method of balancing the turbocharger rotating assembly, where the box "A" indicates the connection between the portion of the flow chart shown in FIG. 5A and the portion of the flow chart shown in FIG. 5B.
Figure 5B:
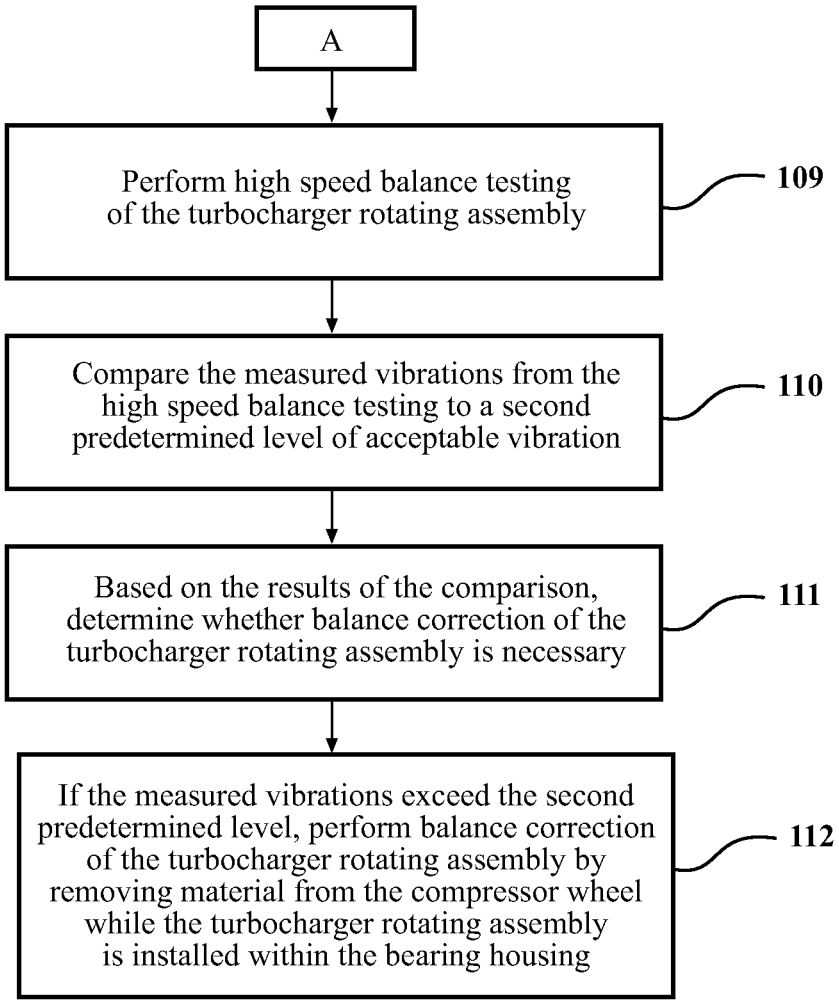

Referring to FIGS. 5A and 5B, a method of balancing the turbocharger rotating assembly 50 will now be described that reduces the level of imbalance of the compressor and turbine wheels 4, 5 when compared to some conventional approaches, so the operating life of the bearing cartridge 20 is increased. The method of balancing the rotating assembly 50 includes the following steps:

An initial balancing of the shaft-and-turbine wheel subassembly 40 is performed in isolation from the remainder of the turbocharger components to address any imbalance of the cast turbine wheel 4 or of the assembly 40 as a whole (step 101). During the initial balancing step, the shaft 6 is held in a jig, and the subassembly 40 is rotated. For example, a jet of air may be applied to the turbine wheel 4 to achieve rotation of the subassembly 40. Vibration of the shaft 6 is measured to determine the extent of imbalance, and to identify corrections. Imbalance is corrected by strategic removal of material from the backwall 34 and/or nose 31 of the turbine wheel 4 (step 102).

Figure 6:
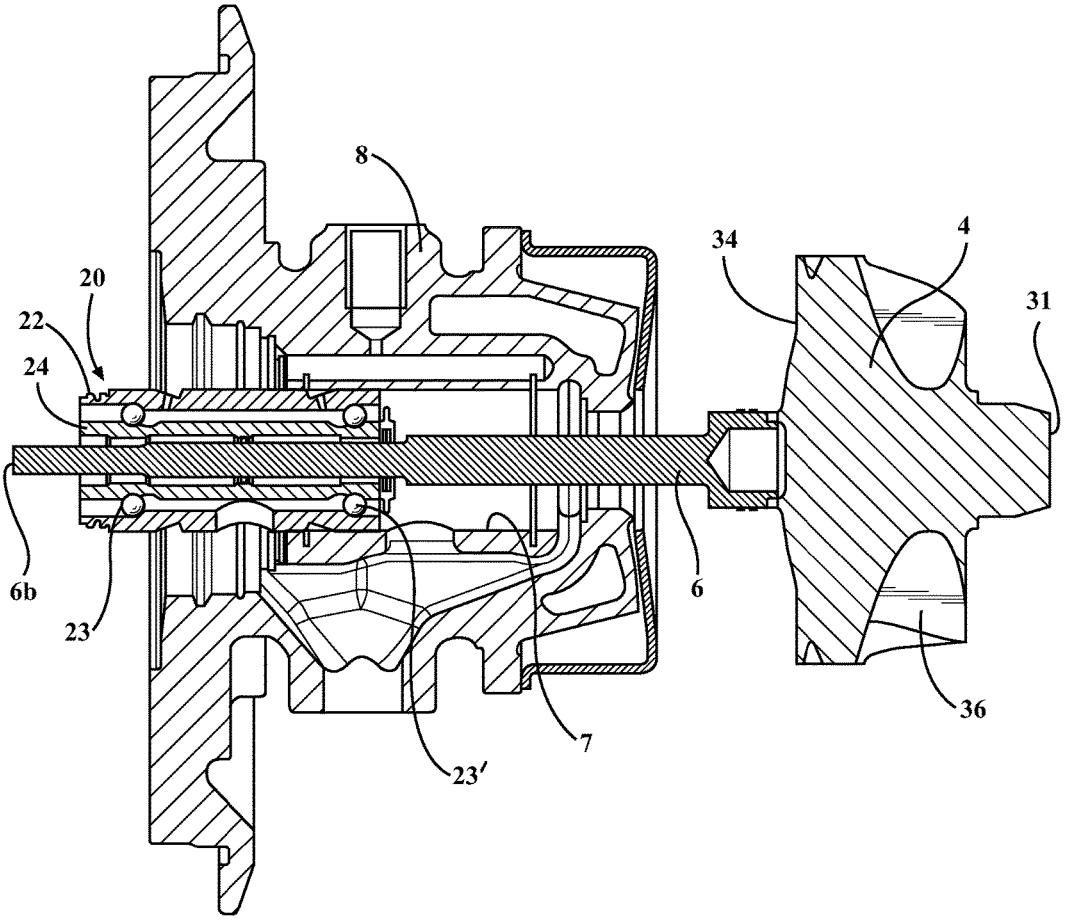
FIG. 6 is a side sectional view of the bearing housing during the step of assembling the shaft-and-turbine wheel subassembly with the bearing cartridge within the bore of the bearing housing.

Referring to FIG. 6, once the shaft-and-turbine wheel subassembly 40 has been adequately initially balanced, it is installed in the bearing housing 8 (step 103). As used herein, the term "initially-balanced shaft-and-turbine wheel subassembly" refers to the shaft-and-turbine wheel subassembly 40 in its assembled and initially-balanced condition prior to assembly with the turbocharger 1. To achieve installation into the bore 7, the free end 6*a* of the shaft 6 is inserted into the turbine-side opening of the bore 7 until the free end 6*a* protrudes outward from the bore 7 on a compressor side of the bearing housing 8 and the backwall 34 of the turbine wheel 4 is adjacent to an axial end face of the bearing housing 8 with minimal clearance. In addition, the rolling element bearing cartridge 20 is mounted on the shaft 6 by inserting the bearing cartridge 20 into the bore 7 on the compressor-side of the bearing housing 8 while inserting the shaft free end 6*a* from the opposed end of the bore 7, until the bearing cartridge 20 abuts a shoulder on the shaft of the shaft-and-turbine wheel subassembly 40 and such that the bearing cartridge 20 is interposed between the shaft 6 and the bore 7 (FIG. 6). The cartridge 20 is prevented from rotating relative to the bore 7 via the ring 28 (seen in FIG. 2) interposed between the cartridge 20 and the bore 7.

Next, the compressor wheel 5 is assembled with the initially-balanced shaft-and-turbine wheel subassembly 40, which remains supported by the bearing cartridge 20 within the bore 7. The compressor wheel 5 is secured to the shaft free end 6*b* via the nut 21 (e.g., a locknut), as shown in FIG. 2 (step 104). The resulting turbocharger rotating assembly 50, which includes the compressor wheel 5, the bearing cartridge 20, and the shaft-and-turbine wheel sub assembly 40, is disposed in the bore 7.

However, when the nut 21 is tightened, the shaft 6 is shifted and becomes slightly bent due to end parallelism of the stack of components being clamped together, resulting in increased imbalance of the compressor wheel end of the rotor assembly 50. At this point in some conventional balancing procedures, balance corrections are only made to the compressor wheel side, for example by removal of material from the compressor wheel 5. However, geometric variations in the inner race 24 of the ball bearing cartridge 20 can cause the mass of the shaft 6 and turbine wheel 4 to be offset from the axis of rotation of the bearing cartridge 20, resulting in imbalance that is much greater than the shaft-and-turbine wheel subassembly's 40 imbalance limit prior to installation into the bearing housing 8. In some cases, the resulting imbalance cannot be sufficiently corrected by making balance corrections to the compressor end of the rotor assembly 50.

Moreover, clearances internal to the bearing and between the bearing cartridge 20 and the bore 7 exist that can confound balancing of the rotating elements of the turbocharger 1.

For example, referring to FIGS. 2 and 4, an internal radial clearance exists $\Delta r_{internal}$ between each set of bearings 23, 23' and the outer surface of the inner race 24 (e.g., at $r_{IR,O}$) and the inner surface of the outer race 22 (e.g., at $r_{OR,I}$). These clearances allow the inner race 24 to move slightly off axis and to tilt with respect to the outer race 22. In FIG. 4, the dashed axial line representing the axis of the outer race 22 ($z_{OR}$), the dotted axial line representing the rotational axis of the inner race 24 ($z_{IR}$) and the angle $\theta_{internal}$ formed between these two axes, which may vary over time. Further, the inner race 24 may translate with respect to the outer race 22, as indicated by a thick double headed arrow and the axial distance $\Delta z_{internal}$, which may vary over time (e.g., as measured by a difference between an axial mid-point of the outer race 22 and an axial mid-point of the inner race 24). As the radius of the inner surface of the outer race 22 ($r_{OR,I}$) increases toward the ends of the bearing cartridge 230, translation of the inner race 24 with respect to the outer race 22 can alter internal clearances ($\Delta r_{internal}$), as can changes in tilt angle ($\theta_{internal}$).

Yet further, the outer race 22 may move in the bore 7 of the bearing housing 8 as it floats on a lubricant film. Such movement may include off axis displacement and/or tilt where the tilt forms an angle $\theta_{damper}$ between the axis of the outer race 22 ($z_{OR}$) and the axis of the bore of the bearing housing 8 ($z_B$). Consider parameters such as $\theta_{damper}$, $\Delta Z_{damper}$, $\Delta r_{damper}$, which may vary with respect to time (e.g., where $\Delta z_{damper}$ may be a difference between an axial mid-point of the outer race 22 and an axial mid-point of a housing bore and where $\Delta r_{damper}$ may be a difference between an outer diameter of the outer race 22 and an inner diameter of a housing bore). Air drive of a shaft-and-turbine wheel subassembly 40, per a conventional balancing method, usually results in movement of the inner race 24 with respect to the outer race 22 and/or the outer race 22 with respect to the bore of the bearing housing 8. Thus, when a bearing cartridge (e.g., bearing cartridge 20) is positioned in a housing, multiple angles (e.g., $\theta_{damper}$, $\theta_{internal}$), clearances ($\Delta r_{damper}$, $\Delta r_{internal}$) and axial displacements ($\Delta z_{damper}$, $\Delta z_{internal}$) may exist, which can confound balancing.

Once the initially-balanced shaft-and-turbine wheel subassembly 40 is installed in the bore 7 with the bearing cartridge 20 interposed between the shaft 6 and the bore 7, and the compressor wheel 5 has been connected to the shaft free end 6*b*, low speed balance testing of the rotating assembly 50 is performed (step 105). Low speed balance testing includes causing the shaft 6 to rotate at low speed within the bore 7 while supported by the bearing cartridge 20. This is achieved by, for example, directing a flow of air toward the turbine wheel 4 or by connecting the subassembly 40 to an output shaft of a high speed motor via belt. As used herein, the term "low speed" refers to speeds corresponding to that of the first bending mode of the rotating assembly 50 or less. This will depend on the size and geometry of the rotating assembly 50. For example, in some cases, a low speed may refer to speeds less than or equal to 5000 rpm, while in other cases, a low speed may refer to speeds less than or equal to 20,000 rpm.

Balance testing further includes measuring the speed and vibrations of the rotating assembly 50 while the shaft 6 is rotated. The vibration measurements can be made using an accelerometer, and are performed in one or more planes along the rotational axis R of the turbocharger 1. For example, measurements may be made in a first plane transverse to the axis of rotation R that includes the peripheral edge 35, and in a second plane transverse to the axis of rotation R that includes the turbine wheel nose 31. A conventional speed sensor is used to obtain measurements of the speed of rotation of the shaft 6 and/or the turbine wheel 4.

To address the balance-confounding angles, clearances and axial displacements associated the bearing cartridge 20 described above, the shaft-and-turbine wheel subassembly 40 and the bearing cartridge 20 are pre-loaded within the bore 7 during balance testing using a combination of techniques. These techniques may include, and are not limited to, one or more of the following: using the anti-rotation ring 28 alone, or along with a damping ring (not shown) to axially locate, dampen axial movement and cushion axial thrust of the bearing cartridge 20; application of a radial pre-load to the bearing cartridge 20 via fixture inserted through the bearing housing oil drain 26; and application of a bending moment to the shaft via a drive belt connected to the turbine wheel nose 31.

The measured vibrations are compared to a first predetermined level of acceptable imbalance (step 106). This value depends on the type and size of the turbocharger 1, including the type and size of turbine wheel 5 and shaft 6, and has been determined by testing. Based on the results of the comparison, it is determined whether balance correction is necessary (step 107).

Figure 7:
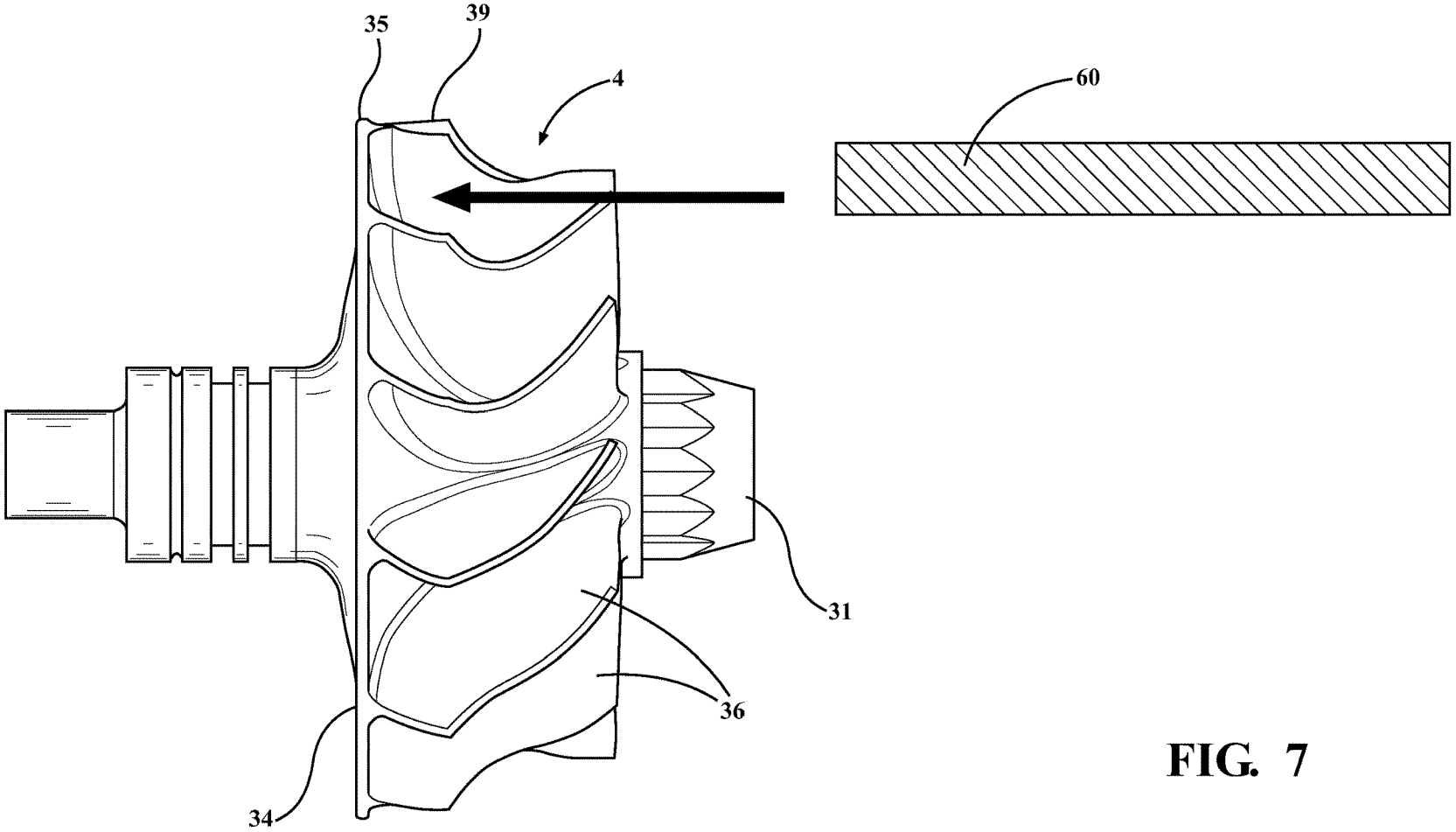
FIG. 7 is a side view of the turbine wheel illustrating the step of advancing a cutting tool toward the backwall from a nose-end of the turbine wheel, where the arrow indicates the direction of advancement.

Referring to FIG. 7, if the measured vibrations exceed the first predetermined level, balance correction is performed by removing material from the turbine wheel 4 while the shaft-and-turbine wheel subassembly 40 is installed within the bearing housing 8 (step 108). In particular, material is removed from a peripheral edge 35 of the turbine wheel backwall 34. It is understood that the material is removed from a portion of the peripheral edge 35, such as between a pair of adjacent turbine blades 36*a*, 36*b*, so that the peripheral edge 35 is not symmetric in the circumferential direction about the axis of rotation 38 of the turbine wheel 4. Removing material from the peripheral edge 35 is advantageous because the peripheral edge 35 is accessible from the nose-end of the turbine wheel, and is a portion of the turbine wheel 4 that is not in, and/or minimally affects, the flow path of air through the turbine wheel 4 when in use in the turbocharger 1. Material removal is achieved by advancing a cutting tool 60 toward the turbine wheel backwall 34 by approaching the backwall 34 from a nose-side of the turbine wheel 4.

Figure 8:
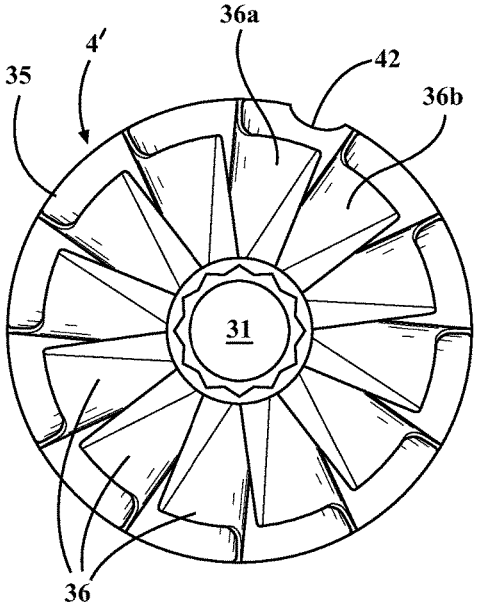
FIG. 8 is a front view of the turbine wheel illustrating a scallop formed in the peripheral edge between a pair of adjacent blades.
Figure 9:
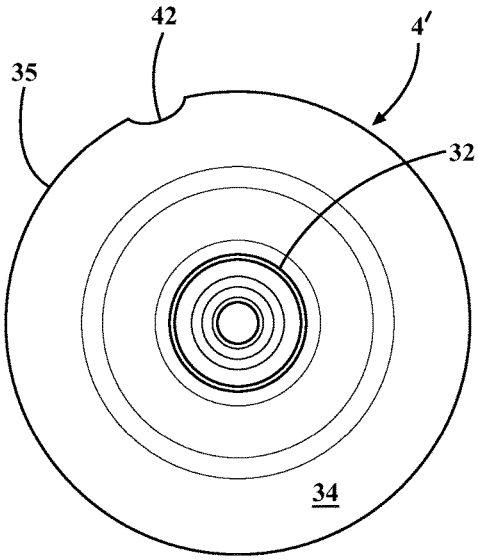
FIG. 9 is a rear view of the turbine wheel of FIG. 8 illustrating the scallop formed in the peripheral edge.

Referring to FIGS. 8 and 9, in some embodiments, the step of removing material from a peripheral edge 35 of the turbine wheel backwall 34 includes using the cutting tool 60 to machine at least one scallop 42 in the peripheral edge 35 that is generally semi-circular. This can be accomplished by using a rotating cutting tool having a circular cross sectional shape, and performing a single plunge of the cutting tool 60 through the peripheral edge 35 at a location between a pair of adjacent turbine wheel blades 36*a,* 36*b*.

Figure 10:
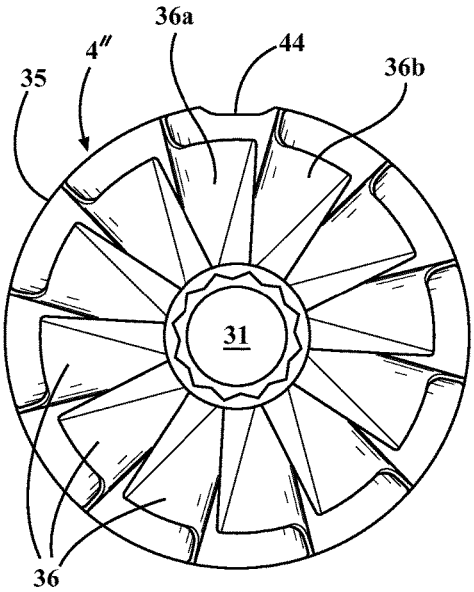
FIG. 10 is a front view of the turbine wheel illustrating an alternative scallop formed in the peripheral edge between a pair of adjacent blades.
Figure 11:
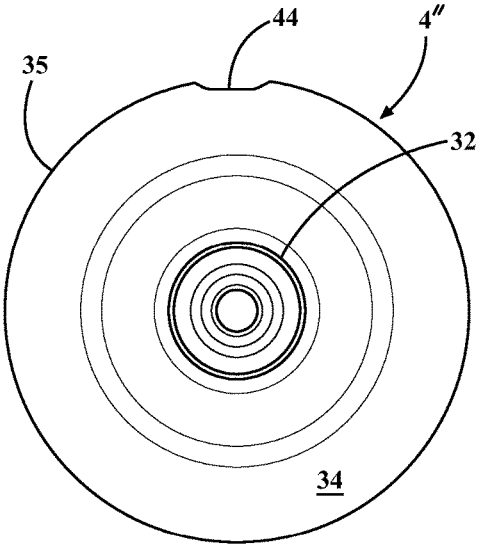
FIG. 11 is a rear view of the turbine wheel of FIG. 10 illustrating the alternative scallop formed in the peripheral edge.

Referring to FIGS. 10 and 11, in some embodiments, the step of removing material from a peripheral edge 35 of the turbine wheel backwall 34 includes using the cutting tool 60 to machine at least one scallop 44 in the peripheral edge 35 that is slightly elongated in the circumferential direction of the turbine wheel 4. This can be accomplished by using a rotating cutting tool having a circular cross sectional shape, and performing multiple, overlapping plunges of the cutting tool 60 through the peripheral edge 35 at a location between a pair of adjacent turbine wheel blades 36*a,* 36*b*. Alternatively, this can be accomplished by performing a single plunge of the cutting tool 60 through the peripheral edge 35 at a location between a pair of adjacent turbine wheel blades 36*a,* 36*b,* and then moving the plunged cutting tool 60 along the circumferential direction.

The scallops 42, 44 are shallow such that their radial dimension is small relative to their circumferential dimension. For example, the depth of each scallop 42, 44 (e.g., the maximum dimension of the scallop 42, 44 in the radial direction) is in a range of about 1 mm to 2 mm. The circumferential length of the scallop 42, 44 is dependent on the spacing between adjacent turbine blades 36, which in turn is dependent on the wheel diameter and the number of blades 36.

Although FIGS. 7-11 illustrate the turbine wheel 4 having a single scallop 42, 44, it is contemplated that multiple scallops can be employed, with a single scallop between a respective adjacent blade pair. In other embodiments, multiple scallops can be provided between a single respective adjacent blade pair as long as sufficient spacing exists between the scallops and the blade fillet to avoid increased blade stress.

Figure 12:
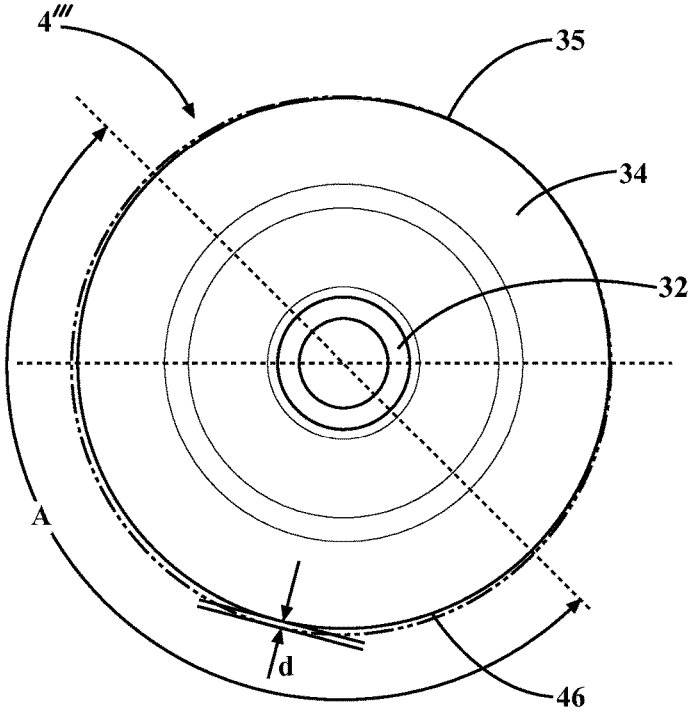
FIG. 12 is a rear view of the turbine wheel illustrating another alternative scallop formed in the peripheral edge.

Referring to FIG. 12, in some embodiments, the step of removing material from a peripheral edge 35 of the turbine wheel backwall 34 includes using the cutting tool 60 applied from the nose-side of the turbine wheel 4 to machine at least one scallop 46 in the peripheral edge 35 that is substantially elongated in the circumferential direction of the turbine wheel 4 such that it begins and ends between adjacent blades 36*a,* 36*b* and extends across at least one blade 36. This can be accomplished by using a rotating cutting tool having a circular cross sectional shape, and performing multiple, overlapping plunges of the cutting tool 60 through the peripheral edge 35 along an arc A that extends across one or more blades 36. Alternatively, this can be accomplished by performing a single plunge of the cutting tool 60 through the peripheral edge 35 at a location between a pair of adjacent turbine wheel blades 36*a,* 36*b,* and then moving the plunged cutting tool 60 along an arc that extends across one or more blades 36. In particular, the beginning and end of the scallop 46 should be spaced apart from the closest blade 36. For example, depending on the size and configuration of the turbine wheel 4 and blade 36, the beginning and end of the scallop 46 should be spaced at least 2 mm the closest blade 36. In addition, the scallop 46 has no sharp curves, and does not overlap other scallops 46. The circumferential length and depth d of the scallop 46 is calculated based on the amount of balance correction required, and the scallop 46 can be provided as a single, elongated scallop (as shown in FIG. 12) or subdivided into two or more shorter scallops 46. The maximum length of the arc A, or the sum of multiple, shorter cuts, corresponds to an angle of 180 degrees. In addition, the depth d of the scallop 46 is uniform along the arc A.

When material has been removed from the peripheral edge 35 of the turbine wheel backwall 34, low speed balance testing of the rotating assembly 50 is repeated. If necessary, additional material is removed from the turbine wheel peripheral edge 35, and testing is repeated until sufficient balance (e.g., a level of vibration that is less than the first predetermined level) of the rotating assembly 50 is achieved.

Once a sufficient balance of the rotating assembly 50 is achieved at low speeds, high speed balance testing of the turbocharger rotating assembly 50 is performed (step 109). High speed balance testing includes causing the shaft 6 to rotate at relatively high speed within the bore 7 while supported by the bearing cartridge 20. This is achieved by, for example, directing a flow of air toward the turbine wheel 4 or by connecting the turbocharger rotating assembly 50 to an output shaft of a high speed motor via belt. As used herein, the term "high speed" refers to speeds of 60,000 rpm to 150,000 rpm, or more.

High speed balance testing further includes measuring the speed and vibrations of the rotating assembly 50 while the shaft 6 is rotated. As before, the vibration measurements are made using an accelerometer, and are performed in one or more planes along the rotational axis R of the turbocharger 1. A conventional speed sensor is used to obtain measurements of the speed of rotation of the shaft 6 and/or the compressor wheel 5.

The measured vibrations are compared to a second predetermined level of acceptable imbalance (step 110). This value depends on the type and size of the turbocharger 1, including the type and size of the compressor wheel 5, and has been determined by testing. Based on the results of the comparison, it is determined whether balance correction is necessary (step 111).

If the measured vibrations exceed the second predetermined level, balance correction is performed by removing material from the compressor wheel 5 while the turbocharger rotating assembly 50 is installed within the bearing housing 8 (step 112). In particular, material is removed from the nut 21 or a hub line of the compressor wheel 5.

When material has been removed from the nut 21 or a hub line of the compressor wheel 5, balance testing is repeated. If necessary, additional material is removed, and testing is repeated until sufficient balance (e.g., a level of vibration that is less than the second predetermined level) of the turbocharger rotating assembly is achieved.

The method described here including steps 101-112 is advantageous relative to some conventional balancing methods that included performing a low-speed balancing of the shaft-and-turbine wheel subassembly 40 externally of the bearing housing 8, followed by insertion of a bearing cartridge 20 from the compressor end of the bearing housing 8 while inserting the shaft of the shaft-and-turbine wheel assembly 40 from the turbine end of the housing. In this conventional approach, once the shaft-and-turbine wheel subassembly is installed in the bore 7, it is difficult to address any adverse effects of the bearing cartridge 20 on the subassembly balance from the turbine wheel end. Other balancing methods have been proposed that include using a special clamp to support a unit that includes the shaft-and-turbine wheel subassembly 40 along with the bearing cartridge 20, balancing the unit externally of the turbocharger 1, and then inserting the unit through an enlarged diameter seal ring opening on the turbine end of the bearing housing 8. Although this conventional method includes balancing the shaft-and-turbine wheel subassembly 40 along with the bearing cartridge 20, it requires the special clamp to hold the unit during balancing, and increases the potential for damaging the bearing cartridge 20, for example by permitting grinding debris to infiltrate the bearing housing when the unit is removed from the fixture and installed in the bearing housing 8. In addition, it requires that the bearing housing turbine end seal ring diameter is larger than the outside diameter of the bearing cartridge so that the unit can be installed through the turbine end of the bearing housing 8, as compared to a conventional housing in which the turbine end seal ring diameter is much smaller than the outer diameter of the bearing cartridge. In some cases, the enlarged turbine end seal ring diameter can lead to increased oil leakage from the bearing housing 8, and increased "blow by", in which exhaust gases pass through the enlarged opening, enter the bearing housing and pass through to the engine crankcase via the lubrication lines. Advantageously, in the method described in steps 101-112, the rotating assembly 50, including the shaft-and-turbine wheel subassembly 40 is balanced while installed within the bearing housing 8 and supported by the bearing cartridge 20. The method described in steps 101-112 allows the balancing to occur without extra installation and removal steps, reduces the likelihood of contamination of the bearing cartridge 20, and allows the use of the optimized turbine end seal diameter.

Although the compressor wheel 5 illustrated herein includes a bore that receives the shaft 6, and is secured to the shaft using the nut 21, the turbocharger 1 is not limited to this configuration. For example, in some embodiments, a bore-less compressor wheel can be used.

A selected illustrative embodiment of the invention is described above in some detail. It should be understood that only structures considered necessary for clarifying the present invention have been described herein. Other conventional structures, and those of ancillary and auxiliary components of the system, are assumed to be known and understood by those skilled in the art. Moreover, while a working example of the present invention has been described above, the present invention is not limited to the working example described above, but various design alterations may be carried out without departing from the present invention as set forth in the claims.

What is claimed:

1. A method of balancing a rotating assembly (50) of a turbocharger (1), comprising the steps of:

performing initial balancing of a shaft-and-turbine wheel subassembly (40) to provide an initially-balanced shaft-and-turbine wheel subassembly (40);

inserting the initially-balanced shaft-and-turbine wheel subassembly (40) into a bearing (20), where the bearing (20) is in a bore (7) of a bearing housing (8) of the turbocharger (1);

securing a compressor wheel (5) to the balanced shaft-and-turbine wheel subassembly (40) to form the turbocharger rotating assembly (50);

performing low speed balance testing of the turbocharger rotating assembly (50) including measurement of low speed vibrations, while the turbocharger rotating assembly (50) is positioned within the bore (7);

comparing the measured low speed vibrations to a first predetermined level of acceptable vibration;

based on the results of comparing the measured low speed vibrations to a first predetermined level of acceptable vibration, determining whether balance correction of the turbocharger rotating assembly (50) is necessary;

if the measured low speed vibrations exceed the predetermined level, performing balance correction of the turbocharger rotating assembly (50) by removing material from a turbine wheel (4) of the shaft-and-turbine wheel subassembly (40) while the shaft-and-turbine wheel subassembly (40) is installed in the bearing (20), and the bearing (20) is installed within the bore (7);

performing high speed balance testing of the turbocharger rotating assembly (50) including measurement of high speed vibrations, while the turbocharger rotating assembly (50) is positioned within the bore (7);

comparing the measured high speed vibrations to a second predetermined level of acceptable vibration;

based on the results of comparing the measured high speed vibrations to a second predetermined level of acceptable vibration, determining whether balance correction of the turbocharger rotating assembly (50) is necessary; and if the measured high speed vibrations exceed the second predetermined level, performing balance correction of the turbocharger rotating assembly (50) by removing material from one of the compressor wheel (5) and the compressor wheel nut (21) while the turbocharger rotating assembly (50) is installed within the bearing housing (8).

2. The method of claim 1, wherein the step of removing the material from the turbine wheel (4) comprises removing material from a peripheral edge (35) of a backwall (34) of the turbine wheel (4).

3. The method of claim 2, wherein the step of removing material from a peripheral edge (35) of a backwall (34) of the turbine wheel (4) includes removing material between a pair of adjacent turbine blades (36*a*, 36*b*) such that the peripheral edge (35) is not symmetric in the circumferential direction about an axis of rotation (38) of the turbine wheel (4).

4. The method of claim 2, wherein the step of removing material from a peripheral edge (35) of a backwall (34) of the turbine wheel (4) includes the step of machining at least one scallop (44) that is elongated in the circumferential direction of the turbine wheel (4).

5. The method of claim 2, wherein the step of removing material from a peripheral edge (35) of a backwall (34) of the turbine wheel (4) includes the step of machining at least one scallop (42) that is generally semi-circular.

6. The method of claim 2, wherein the step of removing material from a peripheral edge (35) of a backwall (34) of the turbine wheel (4) includes the step of machining at least one scallop (46) that is elongated in the circumferential direction of the turbine wheel (4), begins between a first pair of adjacent blades (36*a*, 36*b*), ends between a second pair of adjacent blades (36*a*, 36*b*), and extends across at least one blade (36).

7. The method of claim 1, wherein the step of removing the material from the turbine wheel (4) comprises advancing a cutting tool (60) toward a backwall (34) of the turbine wheel (4) by approaching from a nose-side of the turbine wheel (4).

8. The method of claim 1, wherein testing the balance of the unbalanced shaft-and-turbine wheel subassembly (40) comprises causing the shaft (6) to rotate; and measuring the vibrations of the at least one of the shaft (6) and turbine wheel (4).

9. The method of claim 1, wherein installing a shaft-and-turbine wheel subassembly (40) into a bearing (20) within a bearing housing (8) of a turbocharger (1) comprises inserting a free end (6*b*) of the shaft (6) of the unbalanced shaft-and-turbine wheel subassembly (40) into the bore (7) on a turbine side of the bearing housing (8) until the free end (6*b*) protrudes outward from the bore (7) on a compressor side of the bearing housing (8); and mounting the bearing (20) on the shaft (6) of the unbalanced shaft-and-turbine wheel subassembly (40) by inserting the bearing (20) into the bore (7) on the compressor side of the bearing housing (8) while performing the step of inserting the free end (6*b*) of the shaft (6), until the bearing (20) abuts the portion of the bearing housing (8) and such that the bearing (20) is interposed between the shaft (6) and the bore (7).

10. The method of claim 1, wherein the bearing (20) is a roller element bearing cartridge.

11. A method of balancing a rotating assembly (50) of a turbocharger (1), where the rotating assembly comprises a shaft (6), a turbine wheel (4) connected to one end of the shaft (6), a compressor wheel (5) connected to another end of the shaft (6), and a bearing assembly (20) that supports the shaft (6) within a bore (7) of the turbocharger (1), the method comprising the steps of:

performing low speed balance testing of the turbocharger rotating assembly (50) including measurement of low speed vibrations, while the turbocharger rotating assembly (50) is positioned within the bore (7); and based on results of the low speed balance testing, performing a first balance correction of the turbocharger rotating assembly (50) by removing material from a turbine wheel (4) of the shaft-and-turbine wheel subassembly (40) while the shaft-and-turbine wheel subassembly (40) is installed in the bearing (20), and the bearing (20) is installed within the bore (7).

12. The method of claim 11, further comprising:

performing high speed balance testing of the turbocharger rotating assembly (50) including measurement of high speed vibrations, while the turbocharger rotating assembly (50) is positioned within the bore (7); and based on results of the high speed balance testing, performing a second balance correction of the turbocharger rotating assembly (50) by removing material from one of the compressor wheel (5) and the compressor wheel nut (21) while the turbocharger rotating assembly (50) is installed within the bearing housing (8).

13. The method of claim 11, wherein the step of removing the material from the turbine wheel (4) comprises removing material from a peripheral edge (35) of a backwall (34) of the turbine wheel (4).

14. The method of claim 13, wherein the step of removing material from a peripheral edge (35) of a backwall (34) of the turbine wheel (4) includes removing material between a pair of adjacent turbine blades (36*a*, 36*b*) such that the peripheral edge (35) is not symmetric in the circumferential direction about an axis of rotation (38) of the turbine wheel (4).

15. The method of claim 11, wherein the step of removing the material from the turbine wheel (4) comprises advancing a cutting tool toward a backwall (34) of the turbine wheel (4) by approaching from a nose-side of the turbine wheel (4).

* * * * *